US010899128B2

(12) United States Patent
Kaneko et al.

(10) Patent No.: US 10,899,128 B2
(45) Date of Patent: Jan. 26, 2021

(54) INK JET HEAD AND INK JET RECORDING DEVICE

(71) Applicant: TOSHIBA TEC KABUSHIKI KAISHA, Tokyo (JP)

(72) Inventors: Yoshiaki Kaneko, Mishima Shizuoka (JP); Akimasa Toyama, Yokohama Kanagawa (JP); Tomomi Iijima, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 25 days.

(21) Appl. No.: 16/437,070

(22) Filed: Jun. 11, 2019

(65) Prior Publication Data

US 2020/0031123 A1 Jan. 30, 2020

(30) Foreign Application Priority Data

Jul. 25, 2018 (JP) ..... 2018-139127

(51) Int. Cl.
*B41J 2/14* (2006.01)
*B41J 29/13* (2006.01)

(52) U.S. Cl.
CPC ..... *B41J 2/14* (2013.01); *B41J 29/13* (2013.01); *B41J 2002/14362* (2013.01); *B41J 2002/14491* (2013.01); *B41J 2202/20* (2013.01)

(58) Field of Classification Search
CPC .... B41J 2/14; B41J 29/13; B41J 2002/14362; B41J 2002/14491; B41J 2202/20; B41J 2/14072; B41J 2/01; B41J 2/165
See application file for complete search history.

(56) References Cited

U.S. PATENT DOCUMENTS

| | | | | |
|---|---|---|---|---|
| 9,415,592 | B2 * | 8/2016 | Iijima | B41J 2/14233 |
| 10,538,089 | B2 * | 1/2020 | Kitazawa | H01L 41/042 |
| 2012/0147096 | A1 * | 6/2012 | Yamamoto | B41J 2/14209 347/61 |
| 2013/0076838 | A1 * | 3/2013 | Suzuki | B41J 2/14201 347/68 |

FOREIGN PATENT DOCUMENTS

| | | |
|---|---|---|
| JP | 06-152077 | 5/1994 |
| JP | 06-232513 | 8/1994 |
| JP | 10-341065 | 12/1998 |
| JP | 2008-27693 | 2/2008 |

* cited by examiner

*Primary Examiner* — Henok D Legesse

(74) *Attorney, Agent, or Firm* — Amin, Turocy & Watson, LLP

(57) ABSTRACT

According to one embodiment, an ink jet head includes: a cover including an opening; a flexible cable extending from the opening toward an outside of the cover and having a rigidity lower than the cover; a protection member configured to have rigidity higher than the flexible cable, arranged between the flexible cable and the opening of the cover, and protruding toward an outside of the opening of the cover, while both end portions of an outer end edge of the opening are inclined or curved in a direction in which the flexible cable extends from the opening; and a sealing arranged in the opening in which the flexible cable and the protection member are arranged.

20 Claims, 10 Drawing Sheets

INK JET HEAD AND INK JET RECORDING DEVICE

CROSS-REFERENCE TO RELATED APPLICATION

This application is based upon and claims the benefit of priority from Japanese Patent Application No. 2018-139127, filed Jul. 25, 2018, the entire contents of which are incorporated herein by reference.

FIELD

Embodiments described herein relate generally to an ink jet head and an ink jet recording device.

BACKGROUND

In ink jet heads used in various ink jet recording devices, an ink jet head is proposed which includes a flexible cable for electrical connection with an external device. The flexible cable is thin and flexible, and one end is connected through a connector to an electronic substrate which is housed in a housing of a head, for example. The other end of the flexible cable is connected to the external device, for example. When an actuator is operated through the flexible cable by an electrical signal input from the external device, the ink jet head discharges ink droplets. Since the flexible cable is thin and flexible, the routing space of the cable can be reduced. Thus, the entire device including the external device as well as the head can be reduced in size. In some of such ink jet heads, a cable outlet or a joint is sealed by a sealing such as an adhesive, so as to prevent that the electronic substrate in the housing is broken by the infiltration of ink. However, if the surface of the cured sealing has a keen end portion, the flexible cable may be damaged when the flexible cable is attached to an outer substrate.

DETAILED DESCRIPTION

Embodiments provide an ink jet head and an ink jet recording device in which a flexible cable can be prevented from being damaged.

In general, according to one embodiment, an inkjet head includes: a cover including an opening; a flexible cable extending from the opening toward an outside of the cover and having a rigidity lower than the cover; a protection member configured to have rigidity higher than the flexible cable, arranged between the flexible cable and the opening of the cover, protruding toward an outside of the opening of the cover, while both end portions of an outer end edge of the opening are inclined or curved in a direction in which the flexible cable extends from the opening; and a sealing arranged in the opening in which the flexible cable and the protection member are arranged.

Figure 1:
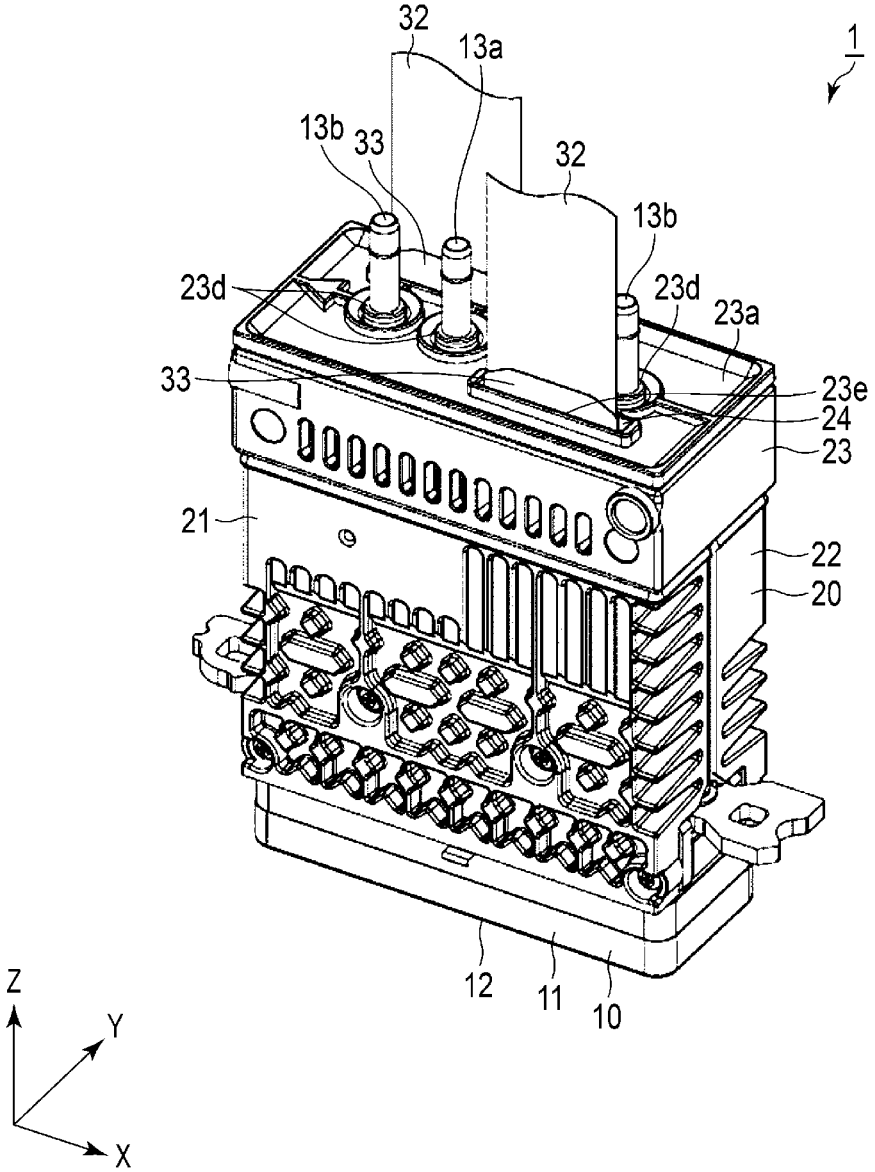
FIG. 1 is a perspective view illustrating a configuration of an ink jet head according to a first embodiment.
Figure 2:
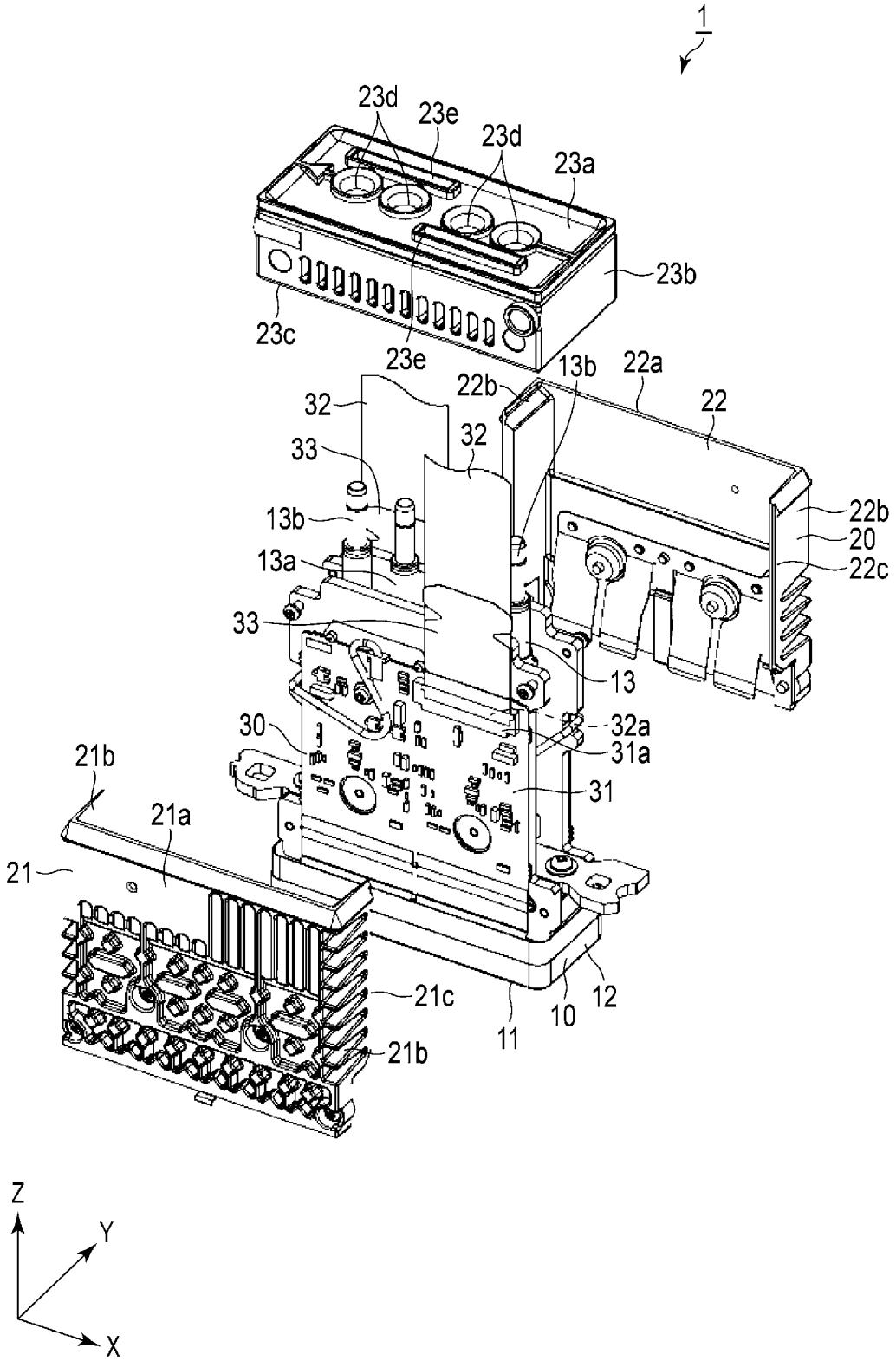
FIG. 2 is an exploded perspective view illustrating the configuration of the ink jet head.
Figure 3:
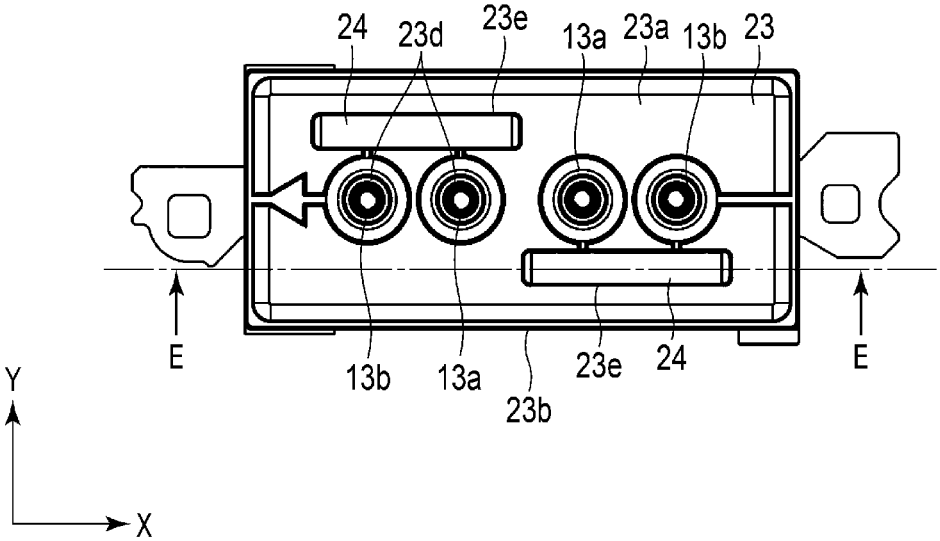
FIG. 3 is a plan view illustrating the ink jet head.
Figure 4:
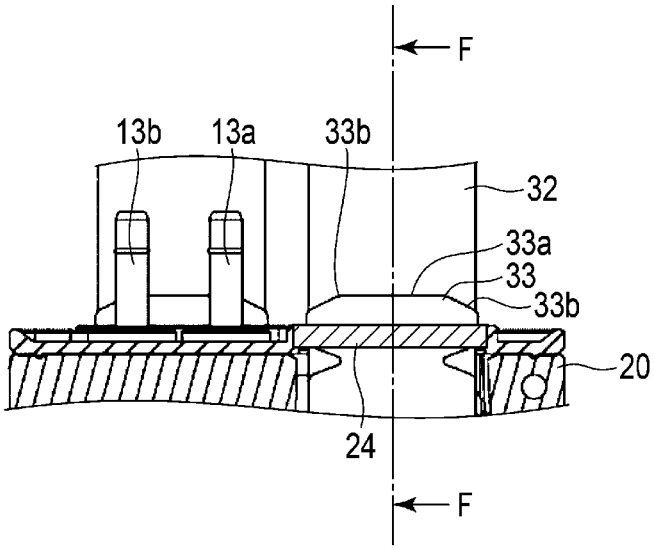
FIG. 4 is a sectional view taken along line E-E of FIG. 3.
Figure 5:
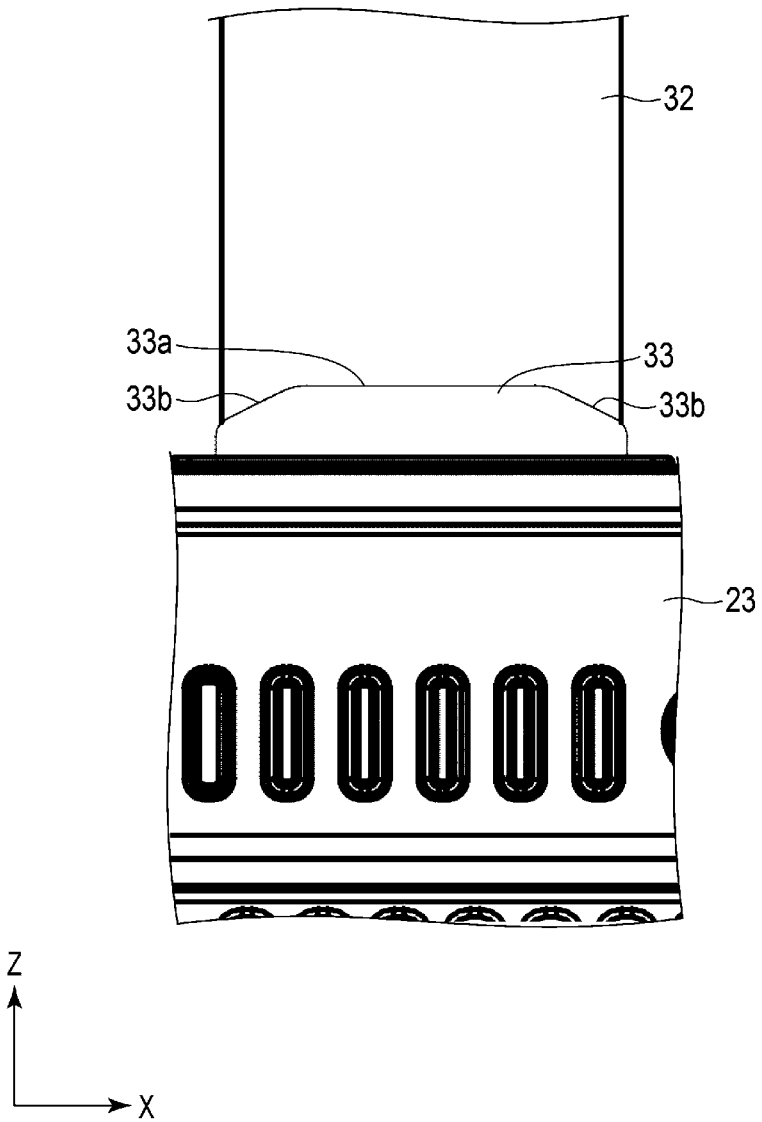
FIG. 5 is an enlarged front view partially illustrating the ink jet head.
Figure 6:
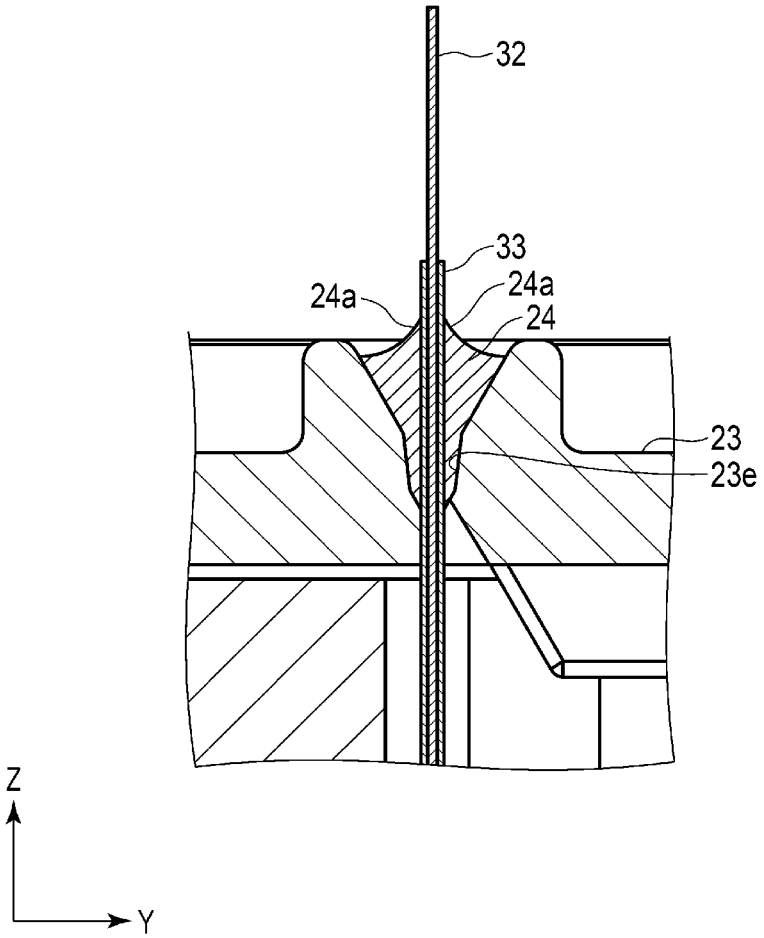
FIG. 6 is a sectional view taken along line F-F of FIG. 4.

Hereinafter, an ink jet head 1 according to a first embodiment will be described with reference to FIGS. 1 to 7. FIG. 1 is a front view illustrating the configuration of the ink jet head 1 according to the first embodiment. FIG. 2 is an exploded perspective view illustrating the configuration of the ink jet head. FIG. 3 is a plan view illustrating the ink jet head, and FIG. 4 is a sectional view taken along line E-E of FIG. 3. FIG. 5 is an enlarged front view partially illustrating the ink jet head, and FIG. 6 is a sectional view taken along line F-F of FIG. 4. Arrows X, Y, and Z in the drawings indicate three directions which are orthogonal to each other. In the drawings, the configuration is enlarged, reduced, or omitted for explanation.

As illustrated in FIGS. 1 to 7, the ink jet head 1 includes a liquid discharge part 10, a cover 20, and a substrate unit 30.

As illustrated in FIGS. 1 and 2, the liquid discharge part 10 includes an actuator 11 and a nozzle plate 12 which is arranged on the lower surface side of the actuator 11. The liquid discharge part 10 is arranged below the substrate unit 30.

A plurality of passage tubes such as a supply tube 13*a* and a recovery tube 13*b* are connected to the liquid discharge part 10. In the supply tube 13*a* and the recovery tube 13*b*, for example, one ends which are arranged on the lower side in FIG. 1 or the like communicate with the liquid discharge part 10, and the other ends on the upper side in the drawings are connected to a supply tank 132.

As illustrated in FIGS. 1 to 3, a cover 20 is arranged above the liquid discharge part 10. The cover 20 has a rectangular housing shape by adhering a plurality of (for example, three) parts with a sealing.

For example, in the present embodiment, the cover 20 includes a first part 21, a second part 22 arranged opposite to the first part 21, and a third part 23 arranged above the first part 21 and the second part 22.

The first part 21 integrally includes a rectangular first wall 21*a* arranged on the front side of the substrate unit 30 and first side walls 21*b* extending rearward from both side edges of the first wall 21*a*.

The second part 22 integrally includes a rectangular second wall 22*a* arranged on the rear surface of the substrate unit 30 and second side walls 22*b* extending forward from both side edges of the second wall 22*a*.

The third part 23 integrally includes a rectangular third wall 23*a* which covers the upper side of a circuit substrate 31 (to be illustrated) and a third peripheral wall 23*b* extending downward from the outer peripheral edge of the third wall 23*a*. A plurality of tube outlets 23*d* which are circular through holes through which the supply tubes 13*a* and the recovery tubes 13*b* are drawn out from the inside of the cover 20 and a plurality of cable outlets 23*e* through which the flexible cables 32 are drawn out are formed in the third wall 23*a*.

As illustrated in FIGS. 1 to 4, for example, the cable outlet 23*e* is a slit-shaped opening long in a first direction and penetrates the third wall 23*a* in a thickness direction. A flexible cable 32 and a protection plate 33 as a protection member for nipping both surfaces of the flexible cable are superposed and arranged in the cable outlet 23*e*. The cable outlet 23*e* has a tapered sectional shape in which the opening width thereof decreases toward the inside of the cover 20, and the opening width increases toward the outside of the cover 20, so as to prevent that a sealing 24 is infiltrated to the inside. The cable outlet 23*e* is sealed by the sealing 24.

The first part 21, the second part 22, and the third part 23 are joined in such a manner that the end edges 21*c*, 22*c*, and 23*c* are butted to each other to be assembled, and spaces between the end edges 21*c*, 22*c*, and 23*c* are sealed by the sealing 24.

As illustrated in FIGS. 1 to 6, the sealing 24 is formed of a resin material such as an epoxy thermosetting resin. In the sealing 24, the adhesive applied between the cable outlet 23*e* and the end edges 21*c*, 22*c*, and 23*c* in a manufacturing process is cured by heat treatment, so that the gaps between the outlet 23*e* and the end edges 21*c*, 22*c*, and 23*c* are filled to be sealed. Here, as illustrated in FIG. 6, in the sealing 24 arranged in the cable outlet 23*e*, the outer surface of the adhesive is bent and cured by a surface tension, so that the edge portion on the protection plate 33 side becomes in a keen shape. The cured sealing 24 has rigidity higher than the flexible cable 32, for example.

The substrate unit 30 includes the rectangular plate-shaped circuit substrate 31 which is erected on the internal space of the cover 20, the flexible cable 32 connected to one end side of the circuit substrate 31, and the protection plates 33 arranged on both surfaces of the flexible cable 32.

The circuit substrate 31 is supported and erected on the liquid discharge part 10. Various electronic components such as a drive IC are mounted in the circuit substrate 31. For example, the circuit substrate 31 is connected to the liquid discharge part 10 through a flexible substrate. A connector base 31*a* connected with the flexible cable 32 is mounted at a predetermined place near the end edge on the upper side of the circuit substrate 31.

The flexible cable 32 is in a band shape having a predetermined width and includes a plurality of wires arranged along a longitudinal direction. The flexible cable 32 includes a cable connector 32*a* on one end side.

The flexible cable 32 is connected to the circuit substrate 31 in such a manner that the cable connector 32*a* arranged on one end side is inserted and engaged to the connector base 31*a* of the circuit substrate 31. In the flexible cable 32, the cable connector 32*a* on one end side is arranged in the cover 20, and the other side is drawn out and extends through the cable outlet 23*e* toward the outside of the cover 20 in a second direction. The other end side of the flexible cable 32 is connected to the outer substrate arranged at a predetermined place outside the cover 20. The flexible cable 32 is thin and flexible and is arranged to a predetermined connection destination arranged outside the cover 20 according to a deformation such as a bending or torsion.

In the cable outlet 23*e*, the flexible cable 32 is sandwiched between a pair of protection plates 33. That is, the pair of protection plates 33 is stuck through patches such as an adhesive tape between the inner edge of the cable outlet 23*e* and the both surfaces of the flexible cable 32. The protection plate 33 has a predetermined thickness and is a sheet-like member configured of a resin material such as PI and PET to have rigidity higher than the flexible cable 32. Each protection plate 33 has a predetermined height dimension to reach the inside and outside of the outlet 23*e* and has a width dimension larger than the width dimension of the flexible cable 32 in the first direction. Therefore, the side edge portions on both sides of the flexible cable 32 are covered with the pair of protection plates 33.

The protection plate 33 includes a protrusion part protruding to the outside of the cover 20, and the end portion outside the cover 20 is in a trapezoidal shape. That is, the both end portions 33*b* of the end edge 33*a* of the protection plate 33 outside the cover 20 include edge portions which are inclined in the first direction such that the central portion in the width direction is positioned more outward of the cover 20 than the both end portions. The edge portions of the both end portions 33*b* are inclined with respect to the first direction along the width direction of the slit-shaped cable outlet 23*e* which is the width direction of the flexible cable 32 and the second direction along the extending direction in which the flexible cable 32 is drawn out. For example, a shape such as an inclination angle or a dimension ratio of the both end portions 33*b* of the protection plate 33 is set according to the arrangement condition of the flexible cable 32. For example, the inclination angle is set to be 20 to 70° with respect to the first direction of the both end portions 33*b*.

The flexible cable 32 has an outer shape in which the end edge 33*a* is gently displaced without no keen portion or corner. Therefore, for example, if the flexible cable 32 is pulled and bent outside the cover 20, the flexible cable 32 is pressed against the end edge 33*a* of the protection plate 33. However, since the edge portions of the both end portions 33*b* are inclined, in the flexible cable 32, the pressure can be dispersed such that the protection plate 33 receives the pressure at wider areas, and thus the pressure can be released stepwise. Therefore, the flexible cable 32 is hardly broken.

In the ink jet head 1 configured as described above, for example, when the driving voltage is applied by the drive IC mounted on the circuit substrate 31, the actuator 11 is driven, and droplets are discharged from the nozzle.

Figure 7:
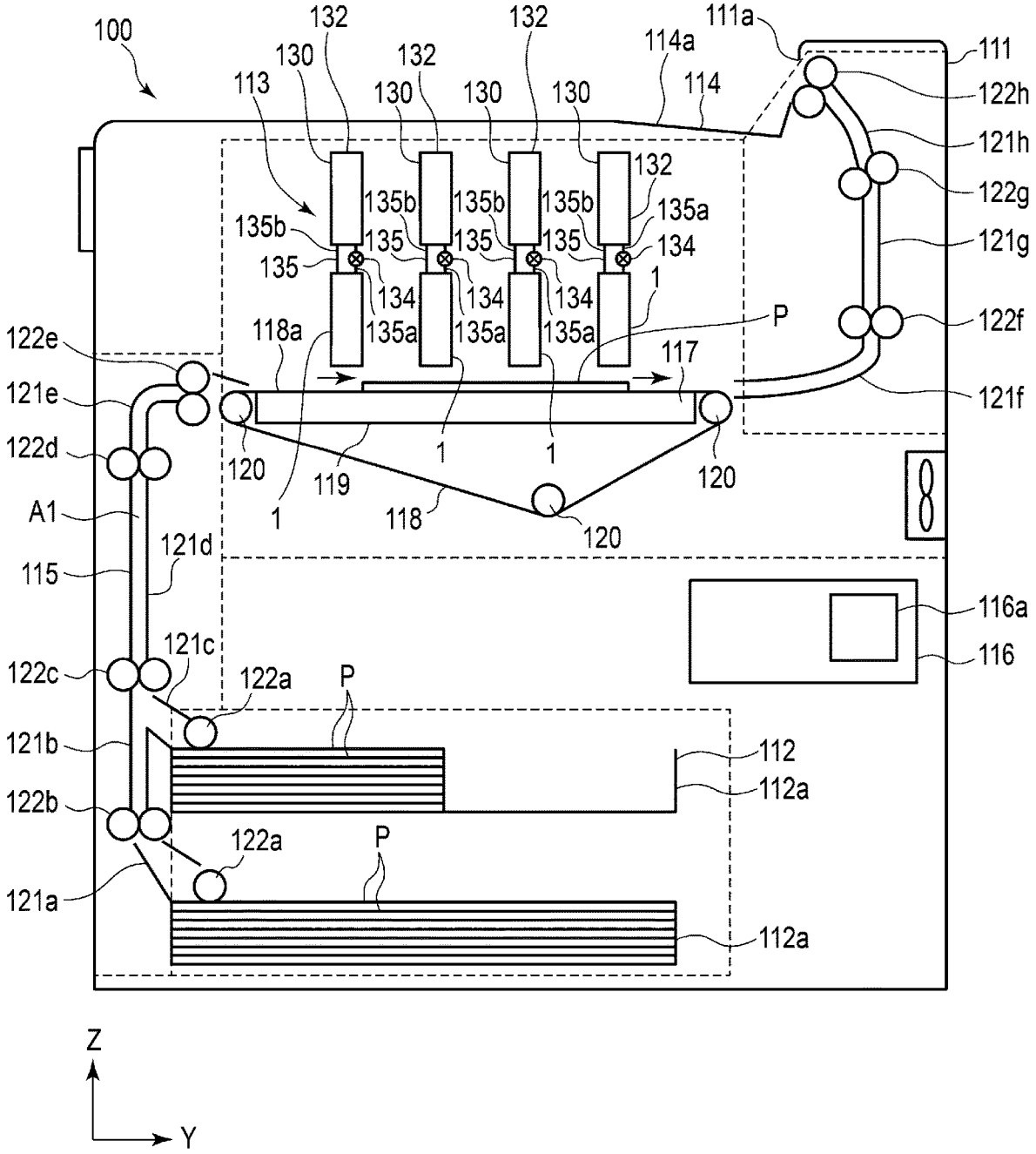
FIG. 7 is an explanation view illustrating a configuration of an ink jet recording device of the ink jet head.

For example, the ink jet head 1 is provided in an ink jet recording device 100 illustrated in FIG. 7. The ink jet head 1 is connected to the supply tank 132 as a liquid storage part provided in the ink jet recording device 100 and is a circulation head which circulates ink between the inkjet head and the supply tank 132. For example, the ink jet head 1 is arranged such that the nozzle of the liquid discharge part 10 is directed downward.

Hereinafter, the ink jet recording device 100 including the ink jet head 1 will be described with reference to FIG. 7. The ink jet recording device 100 includes a housing 111, a medium supply part 112, an image forming part 113, a medium discharge part 114, a conveyance device 115 as a support device, and a control part 116.

The ink jet recording device 100 is an ink jet printer which performs image forming processing on a paper P by discharging a liquid such as ink while conveying, for example, the paper P as a recording medium which is a discharging object along a predetermined conveyance path A1 which reaches from the medium supply part 112 through the image forming part 113 to the medium discharge part 114.

The medium supply part 112 includes a plurality of paper feeding cassettes 112*a*. The medium discharge part 114 includes a paper discharging tray 114*a*. The image forming part 113 includes a support part 117 which supports papers and a plurality of head units 130 oppositely arranged above the support part 117. The support part 117 includes a conveyance belt 118 provided in a loop shape in a predetermined area for forming an image, a support plate 119 which supports the conveyance belt 118 from the back side, and a plurality of belt rollers 120 provided on the back side of the conveyance belt 118.

The head unit 130 includes the ink jet head 1 which is a plurality of ink jet heads, a plurality of supply tanks 132 which are liquid tanks mounted on respective ink jet heads 1, a connection passage 135 which connects the ink jet head 1 and the supply tank 132, and a circulation pump 134 which is a circulation part. The head unit 130 is a circulation head unit which circulates liquid.

In the present embodiment, the ink jet head 1 including four colors of cyan, magenta, yellow and black is provided as the ink jet head 1, and the supply tank 132 is provided as the supply tank 132 which stores ink of each color. The supply tank 132 is connected to the ink jet head 1 by the connection passage 135. The connection passage 135 includes a supply passage 135*a* which is connected to the supply tube 13*a* of the ink jet head 1 and a recovery passage 135*b* which is connected to the recovery tube 13*b* of the ink jet head 1.

A negative pressure control device such as a pump (not illustrated) is connected to the supply tank 132. The inside of the supply tank 132 is negative-pressure controlled to correspond to a water head value of the ink jet head 1 and the supply tank 132 by the negative pressure control device, so that the ink supplied to each nozzle of the ink jet head 1 is formed into a meniscus having a predetermined shape.

The circulation pump 134 is a liquid feed pump configured as a piezoelectric pump, for example. The circulation pump 134 is connected to the control part 116 by wires and is configured to be controllable by the control of a central processing unit (CPU) 116*a*. The circulation pump 134 circulates liquid through a circulation passage including the ink jet head 1 and the supply tank 132.

The conveyance device 115 conveys the paper P along the conveyance path A1 which reaches from the paper feeding cassette 112*a* of the medium supply part 112 through the image forming part 113 to the paper discharging tray 114*a* of the medium discharge part 114. The conveyance device 115 includes a plurality of guide plate pairs 121*a* to 121*h* which are arranged along the conveyance path A1 and a plurality of conveyance rollers 122*a* to 122*h*. The conveyance device 115 supports the paper P to the ink jet head 1 in a relatively movable manner.

The control part 116 includes a CPU 116*a* as one example of a processor, a read only memory (ROM) which stores various programs or the like, a random access memory (RAM) which temporarily stores various variable data, image data, or the like, and an interface part which inputs data from the external part and outputs data to the external part.

In the ink jet head 1 and the ink jet recording device 100, while driving is performed which discharges liquid from the nozzle, the control part 116 applies a driving voltage to a driving element of the actuator 11 to operate the actuator 11 and discharge ink droplets from the nozzle.

In the ink jet head 1 configured as described above, the ink reaches from the supply tank 132 illustrated in FIG. 7 through the supply passage 135*a* and the supply tube 13*a* to a pressure chamber of the liquid discharge part 10 and is discharged from the nozzle arranged opposite to the pressure chamber. On the other hand, the ink is recovered and circulated from the pressure chamber through the recovery tube 13*b* and the recovery passage 135*b* to the supply tank 132.

In the ink jet head 1 and the ink jet recording device 100 according to the present embodiment, since the protection plate 33 is provided between the sealing 24 and the flexible cable 32, it can be prevented that the flexible cable 32 is broken by a keen end portion of the sealing 24, for example, when the flexible cable 32 is pulled or bent. In the protection plate 33, since the edge portion of the both end portions 33*b* is inclined, stress can be dispersed stepwise. Therefore, the flexible cable 32 is hardly broken.

Since the protection plate 33 is only a part corresponding to the cable outlet 23*e*, the material can be reduced in size, and the flexibility of the flexible cable 32 can be protected compared to a configuration in which the entire flexible cable 32 is covered or thickened, for example.

Since the protection plate 33 has a width dimension larger than the flexible cable 32, a positional accuracy during sticking can be alleviated.

The invention is not limited to the above-described embodiment. The components can be modified to be embodied in the implementation phase within the scope of the invention.

Figure 8:
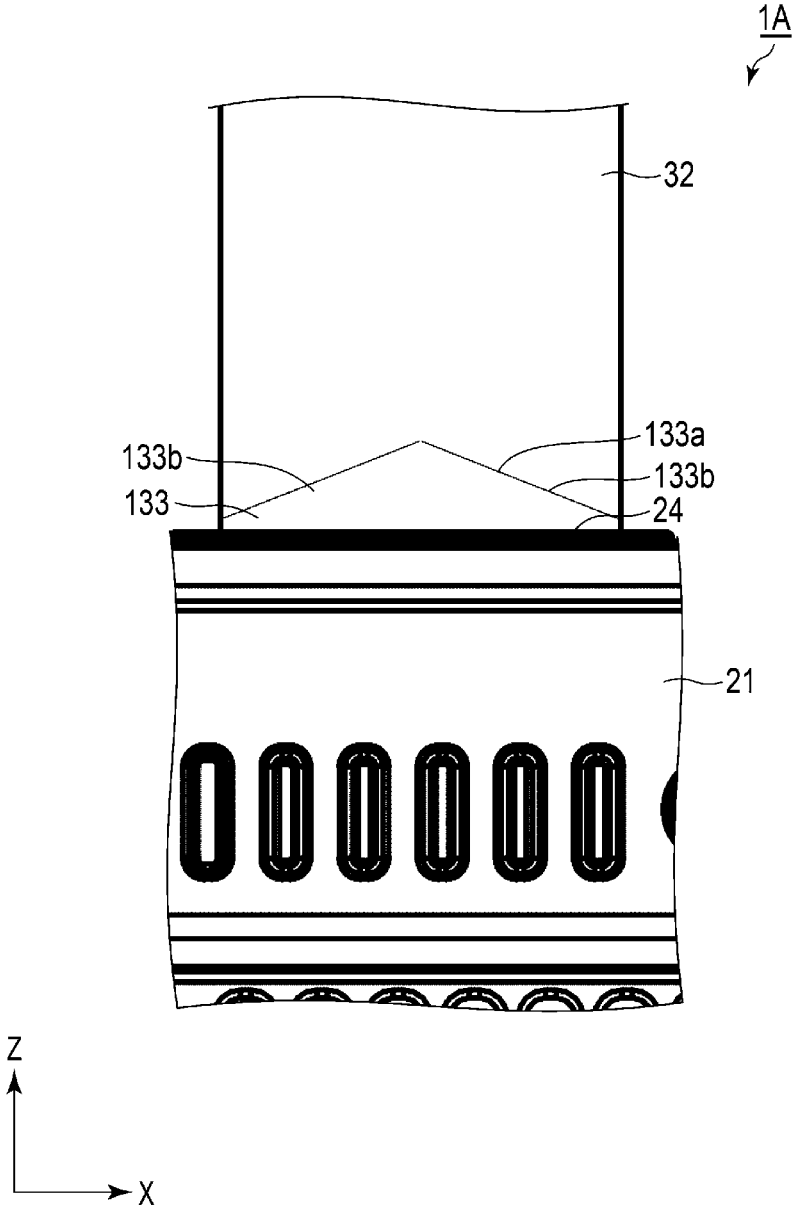
FIG. 8 is an explanation view illustrating a partial configuration of an ink jet head according to another embodiment.

In the first embodiment, the example is described in which the end portion is in a trapezoidal shape. However, the invention is not limited thereto. FIG. 8 is an enlarged front view partially illustrating an ink jet head 1A according to another embodiment. As illustrated in FIG. 8, in a protection plate 133 of the ink jet head 1A, an end edge 133*a* is in a triangular shape. Specifically, the protection plate 133 includes a pair of edge portions 133*b* inclined such that the center is positioned outside the cover 20.

Figure 9:
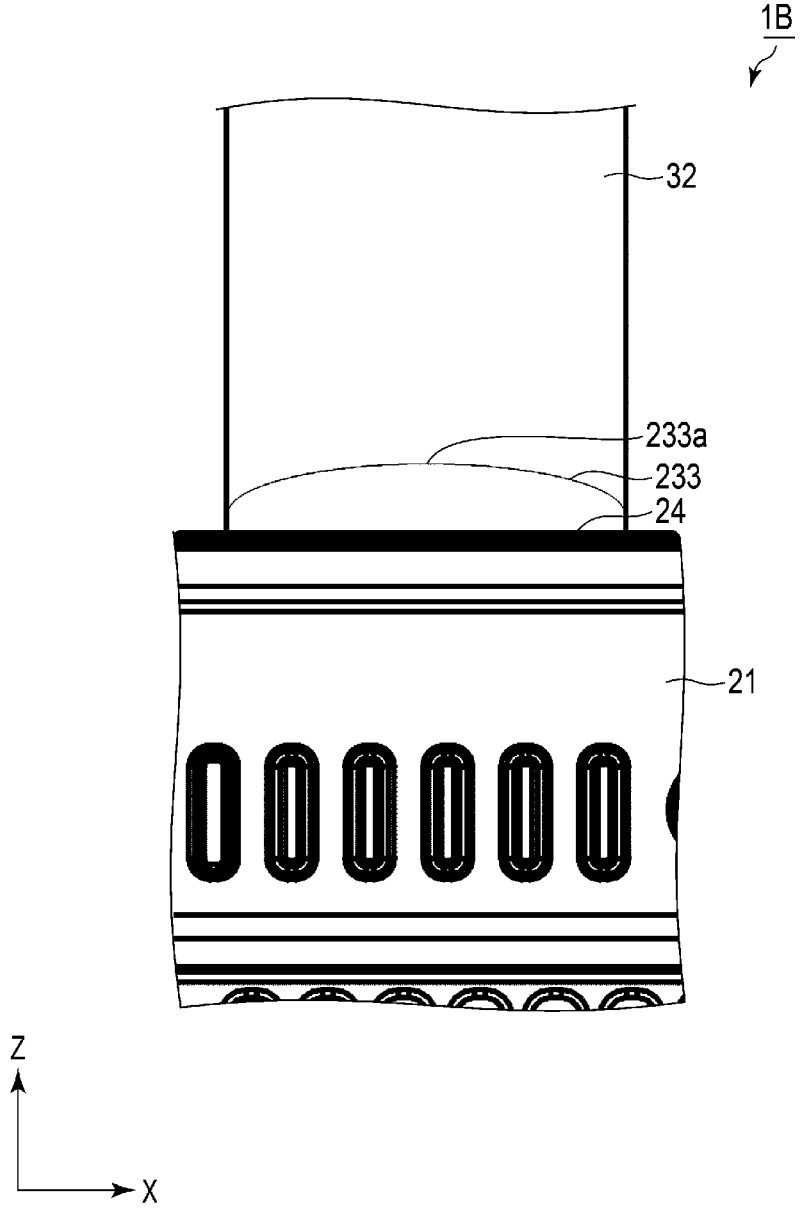
FIG. 9 is an explanation view illustrating a partial configuration of an ink jet head according to still another embodiment.

FIG. 9 is an enlarged front view partially illustrating an ink jet head 1B according to still another embodiment. As illustrated in FIG. 9, a protection plate 233 of the ink jet head 1B includes an edge portion 233*a* which is curved such that the center is positioned outside the cover 20. Also in the present embodiment, the same effect can be obtained as in the first embodiment. That is, the flexible cable 32 can be protected from the keen end edge of the sealing 24 by the protection plate 233, and the end edge 233*a* of the protection plate 233 is formed in a curved shape. Thus, when the flexible cable 32 is twisted or bent, the force applied to the flexible cable 32 can be dispersed by the protection plate 233 to prevent the breakage of the flexible cable 32.

Figure 10:
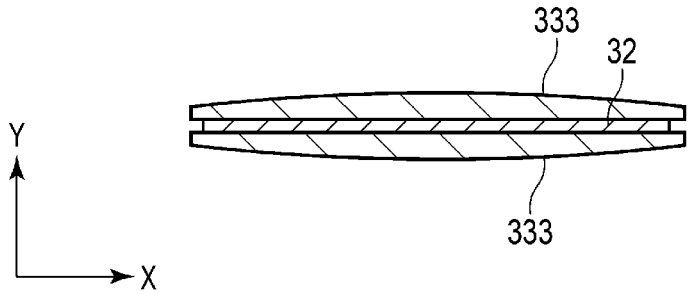
FIG. 10 is an explanation view illustrating a partial configuration of an ink jet head according to still another embodiment.

In the first embodiment, the example is described in which the protection plate 33 has a uniform thickness in the first direction. However, the invention is not limited thereto. FIG. 10 is a sectional view illustrating a protection plate 333 according to still another embodiment. As illustrated in FIG. 10, the thickness of the protection plate 333 is changed such that the center in the first direction is thickened, and both end portions in the first direction are thinned. Both surfaces of the protection plate 333 are curved such that the center is bulged. Other configurations are similar to the first embodiment. Also in the present embodiment, the same effect can be obtained as in the first embodiment. That is, the flexible cable 32 can be protected from the keen end edge of the sealing 24 by the protection plate 333, and the end edge of the protection plate 333 is formed in an inclined or curved shape. Thus, when the flexible cable 32 is twisted or bent, the force applied to the flexible cable 32 can be dispersed by the protection plate 33 to prevent the breakage of the flexible cable 32.

Figure 11:
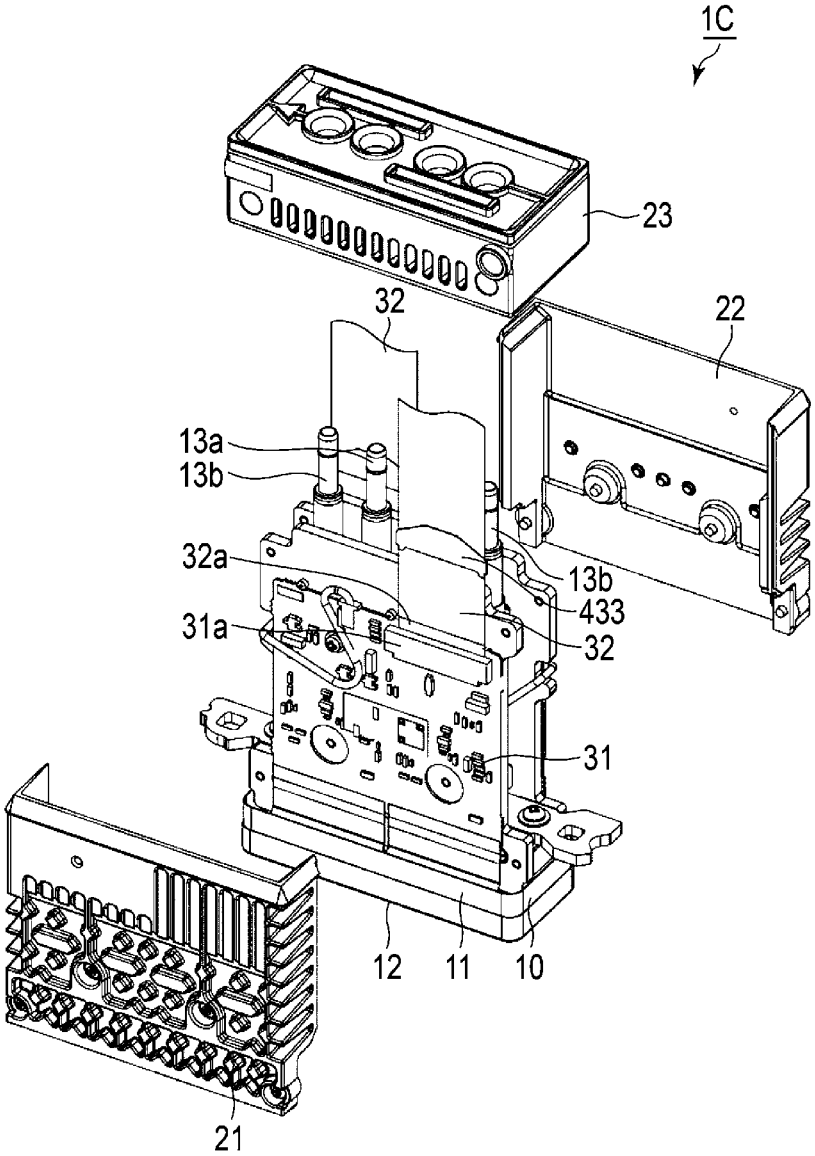
FIG. 11 is an explanation view illustrating a configuration of an ink jet head according to still another embodiment.
Figure 12:
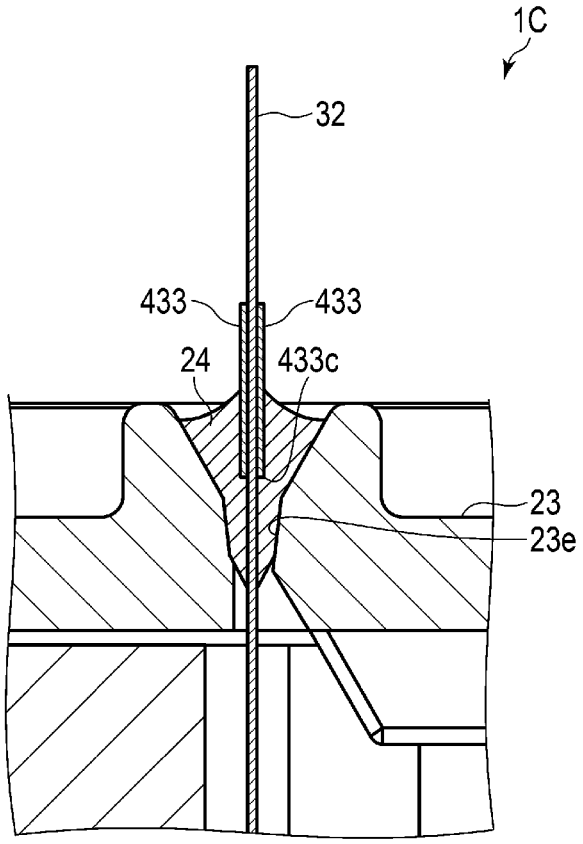
FIG. 12 is a sectional view illustrating the partial configuration of the ink jet head.
Figure 13:
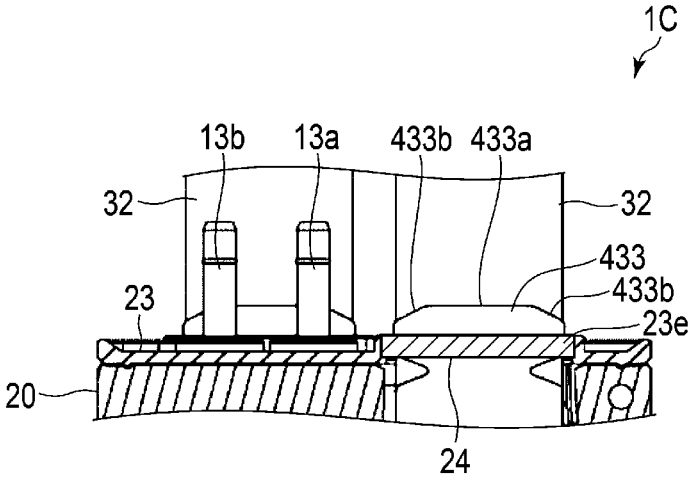
FIG. 13 is a sectional view illustrating the partial configuration of the ink jet head.

In the first embodiment, the example is described in which the protection plate 33 has a height dimension reaching the internal space of the cover 20. However, the invention is not limited thereto. FIG. 11 is an exploded perspective view illustrating a configuration of an ink jet head 1C according to still another embodiment. FIGS. 12 and 13 are a sectional view partially illustrating the ink jet head 1C. As illustrated in FIGS. 11 to 13, the protection plate 433 in the ink jet head 1C is arranged such that an end edge 433*c* positioned inside the cover 20 is buried into the sealing 24 and is sandwiched into the cable outlet 23*e* of the cover 20. That is, the end edge of the protection plate 433 according to this embodiment does not reach the inside of the cover 20. Other configurations are similar to the first embodiment.

In the embodiment, the same effect can be obtained as in the first embodiment. That is, the flexible cable 32 can be protected from the keen end edge of the sealing 24 by the protection plate 433, and the end edge of the protection plate 433 is formed in a curved or inclined shape. Thus, when the flexible cable 32 is twisted or bent, the force applied to the flexible cable 32 can be dispersed by the protection plate 433 to prevent the breakage of the flexible cable 32.

In the ink jet head 1C according to the embodiment, the inner end edge of the protection plate 433 remains in the sealing 24 and has a positional relation of not reaching the inside of the cover 20. Thus, it can be prevented that the adhesive configuring the sealing 24 is infiltrated to the inside through the protection plate 433.

In the above-described embodiments, the example is described in which the protection plates 33 are arranged on the both surfaces of the flexible cable 32. The invention is not limited thereto, and the protection plate may be stuck to only one-side surface.

The liquid to be discharged is not limited to ink for printing. For example, a device which discharges liquid containing conductive particles for forming a wire pattern of a printed wiring substrate may be used.

For example, the ink jet head may have a structure in which a vibration plate is deformed by a static electricity to discharge ink droplets, a structure in which thermal energy such as a heater is used to discharge ink droplets from the nozzle, or the like.

In the embodiments, the example is described in which the ink jet head is used for an ink jet recording device such as the ink jet recording device, but is not limited thereto. For example, the ink jet head can be also used for 3D printers, industrial manufacturing machines, and medical applications, so as to reduce in size, weight, and cost.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet head, comprising:

a cover having an opening therein;

a flexible cable extending from the opening toward an outside of the cover and having a rigidity lower than a rigidity of the cover;

a protection member having a rigidity higher than the rigidity of the flexible cable, arranged between the flexible cable and the opening of the cover, and protruding toward an outside of the opening of the cover, while both end portions of an outer end edge of the opening are inclined or curved in a direction in which the flexible cable extends from the opening; and a sealing provided in the opening in which the flexible cable and the protection member are arranged.

2. The head according to claim 1, wherein the opening has a slit extending in a predetermined first direction, the flexible cable has a band shape and is connected to a substrate arranged inside the cover so as to extend from the opening in a second direction intersecting with the first direction, the protection member has a plate shape such that end edges of the both end portions in the first direction are inclined or curved with respect to the first direction and the second direction, and the rigidity of the sealing is higher than the rigidity of the flexible cable.

3. The head according to claim 1, wherein the protection members are arranged on both surfaces of the flexible cable.

4. The head according to claim 1, wherein a width dimension of the protection member is larger than a width dimension of the flexible cable.

5. The head according to claim 1, wherein the sealing comprises a resin material.

6. The head according to claim 1, wherein the sealing comprises an epoxy thermosetting resin.

7. The head according to claim 1, wherein the flexible cable comprises a plurality of wires arranged along a longitudinal direction.

8. The head according to claim 1, with the priviso that the sealing does not creep inside the cover.

9. An ink jet recording device, comprising:

an ink jet head comprising:

a cover having an opening therein;

a flexible cable extending from the opening toward an outside of the cover and having a rigidity lower than a rigidity of the cover;

a protection member having a rigidity higher than the rigidity of the flexible cable, arranged between the flexible cable and the opening of the cover, and protruding toward an outside of the opening of the cover, while both end portions of an outer end edge of the opening are inclined or curved in a direction in which the flexible cable extends from the opening; and a sealing provided in the opening in which the flexible cable and the protection member are arranged.

10. The device according to claim 9, wherein the opening has a slit extending in a predetermined first direction, the flexible cable has a band shape and is connected to a substrate arranged inside the cover so as to extend from the opening in a second direction intersecting with the first direction, the protection member has a plate shape such that end edges of the both end portions in the first direction are inclined or curved with respect to the first direction and the second direction, and the rigidity of the sealing is higher than the rigidity of the flexible cable.

11. The device according to claim 9, wherein the protection members are arranged on both surfaces of the flexible cable.

12. The device according to claim 9, wherein
a width dimension of the protection member is larger than a width dimension of the flexible cable.

13. The device according to claim 9, wherein
the sealing comprises an epoxy thermosetting resin.

14. The device according to claim 9, wherein
the flexible cable comprises a plurality of wires arranged along a longitudinal direction.

15. The device according to claim 9, with the priviso that the sealing does not creep inside the cover.

16. A color printer, comprising:
a medium supply part;
a conveyance part configured to convey a medium; and
an image forming part including an ink jet head configured to form an image on the medium, comprising:
a cover having an opening therein;
a flexible cable extending from the opening toward an outside of the cover and having a rigidity lower than a rigidity of the cover;
a protection member having a rigidity higher than the rigidity of the flexible cable, arranged between the flexible cable and the opening of the cover, and protruding toward an outside of the opening of the cover, while both end portions of an outer end edge of the opening are inclined or curved in a direction in which the flexible cable extends from the opening; and
a sealing provided in the opening in which the flexible cable and the protection member are arranged.

17. The printer according to claim 16, wherein
the opening has a slit extending in a predetermined first direction,
the flexible cable has a band shape and is connected to a substrate arranged inside the cover so as to extend from the opening in a second direction intersecting with the first direction,
the protection member has a plate shape such that end edges of the both end portions in the first direction are inclined or curved with respect to the first direction and the second direction, and
the rigidity of the sealing is higher than the rigidity of the flexible cable.

18. The printer according to claim 16, wherein
the protection members are arranged on both surfaces of the flexible cable.

19. The printer according to claim 16, wherein
a width dimension of the protection member is larger than a width dimension of the flexible cable.

20. The printer according to claim 16, wherein
the sealing comprises an epoxy thermosetting resin and the flexible cable comprises a plurality of wires arranged along a longitudinal direction.

* * * * *